US008050600B2

(12) United States Patent
Maruyama

(10) Patent No.: US 8,050,600 B2
(45) Date of Patent: Nov. 1, 2011

(54) IMAGE FORMATION DEVICE AND DEVELOPER SUPPLYING DEVICE

(75) Inventor: Yasuhiro Maruyama, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 416 days.

(21) Appl. No.: 12/391,333

(22) Filed: Feb. 24, 2009

(65) Prior Publication Data

US 2009/0232560 A1 Sep. 17, 2009

(30) Foreign Application Priority Data

Mar. 13, 2008 (JP) ..... 2008-063454

(51) Int. Cl.
*G03G 15/08* (2006.01)

(52) U.S. Cl. ..... 399/265; 399/291

(58) Field of Classification Search ..... 399/252, 399/265–267, 269–271, 289–291
See application file for complete search history.

(56) References Cited

U.S. PATENT DOCUMENTS

| | | | | |
|---|---|---|---|---|
| 4,598,991 | A | 7/1986 | Hosoya et al. | |
| 5,416,568 | A | 5/1995 | Yoshiki et al. | |
| 7,062,204 | B2 * | 6/2006 | Miyaguchi et al. | 399/252 |
| 7,200,352 | B2 * | 4/2007 | Sakai et al. | 399/266 |

FOREIGN PATENT DOCUMENTS

| | | |
|---|---|---|
| JP | 63-013069 | 1/1988 |
| JP | 05-019616 | 1/1993 |
| JP | 05-031146 | 2/1993 |
| JP | 2008-040045 | 2/2008 |

* cited by examiner

*Primary Examiner* — Hoang Ngo

(74) *Attorney, Agent, or Firm* — Banner & Witcoff, Ltd

(57) ABSTRACT

There is provided an image formation device comprising an developer holding body having a holding surface parallel with a main scanning direction and holding thereon developer; an developer supplying unit to carry developer along a carrying path, wherein the developer supplying unit comprises first carrying electrodes arranged along the carrying path and serving to carry the developer in a carrying direction; second carrying electrodes arranged along the carrying path to face the first electrodes and serving to carry the developer in the carrying direction; a first voltage applying unit to apply a first carrying voltage having a first frequency to the first carrying electrodes; and a second voltage applying unit to apply, to the second carrying electrodes, a second carrying voltage having a second frequency different from the first frequency.

8 Claims, 9 Drawing Sheets

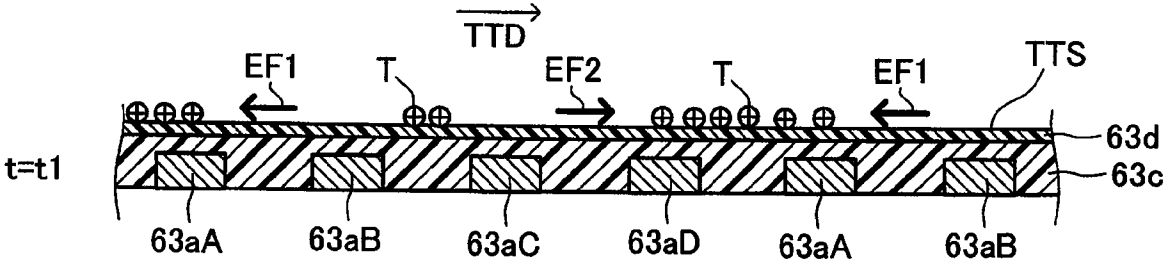
FIG. 4A
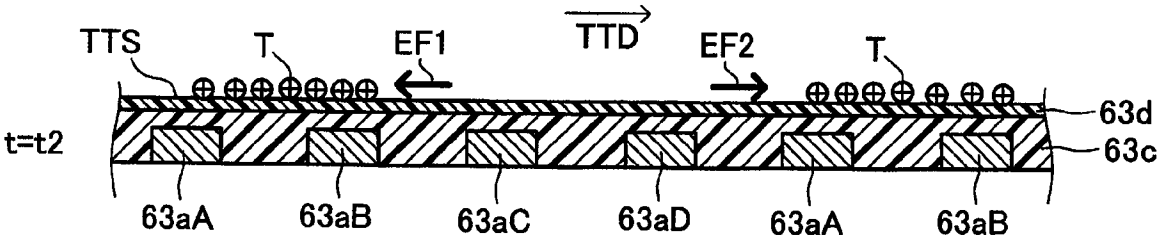
FIG. 4B
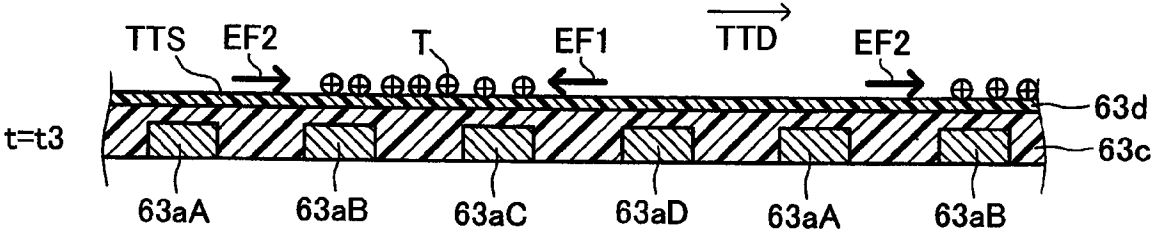
FIG. 4C
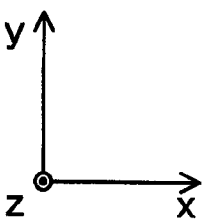

IMAGE FORMATION DEVICE AND DEVELOPER SUPPLYING DEVICE

CROSS-REFERENCE TO RELATED APPLICATION

This application claims priority under 35 U.S.C. §119 from Japanese Patent Application No. 2008-063454, filed on Mar. 13, 2008. The entire subject matter of the application is incorporated herein by reference.

BACKGROUND

1. Technical Field

Aspects of the present invention relate to an image formation device and a developer supplying device.

2. Related Art

Developer supplying devices configured to supply developer (e.g., dry type developer (dry type toner)) to a supply target for developer (e.g., a photosensitive drum) have been widely used. Image formation devices employing such a developer supplying device have also been widely used.

Examples of such image formation devices or developer supplying devices are disclosed in Japanese Patent Provisional Publication No. SHO 63-13069A, Japanese Patent Examined Publication HEI 5-31146, Japanese Patent Provisional Publication No. HEI 5-19616A, and Japanese Patent Provisional Publication No. 2008-40045A (hereafter, referred to as JP2008-40045A).

Among the image formation devices or the developer supplying devices disclosed in the above described publications, the developer carrying device disclosed in JP2008-40045A is configured to employ two developer carrying units located to face with respect to each other. More specifically, the device disclosed in JP2008-40045A is provided with a carrying printed circuit board on which a plurality of carrying electrodes are formed and an opposite printed circuit board on which a plurality of opposite electrodes are formed. Between the carrying printed circuit board and the opposite printed circuit board, a predetermined gap is formed. To the plurality of carrying electrodes of the carrying printed circuit board and the plurality of opposite electrodes of the opposite printed circuit board, voltages for carrying the developer in a predetermined developer carrying direction are respectively applied.

SUMMARY

To achieve suitable image formation on such image formation devices, it is necessary to carry developer smoothly.

Aspects of the present invention are advantageous in that at least one of a developer supplying device and an image formation device capable of carrying developer smoothly in a predetermined direction with a traveling waveform electric field is provided.

According to an aspect of the invention, there is provided an image formation device, comprising: a developer holding body having a developer holding surface which is parallel with a main scanning direction and which holds thereon developer including a number of minute particles; a developer supplying unit configured to carry charged developer to the developer holding body along a developer carrying path. In this configuration, the developer supplying unit comprises: a plurality of first carrying electrodes arranged along the developer carrying path, the plurality of first electrodes serving to carry the developer in a developer carrying direction intersecting with the main scanning direction when a first carrying voltage formed in a traveling waveform is applied to the plurality of first electrodes; a plurality of second carrying electrodes which are arranged along the developer carrying path to face the plurality of first electrodes while sandwiching the developer carrying path between the plurality of first and second electrodes, the plurality of second electrodes serving to carry the developer in the developer carrying direction when a second carrying voltage formed in a traveling waveform is applied to the plurality of second electrodes; a first carrying voltage applying unit configured to apply the first carrying voltage having a first frequency to the plurality of first carrying electrodes; and a second carrying voltage applying unit configured to apply, to the plurality of second carrying electrodes, the second carrying voltage having a second frequency different from the first frequency of the first carrying voltage.

Since the second carrying voltage of which frequency is different from the frequency of the first carrying voltage is applied to the second electrodes, the developer can be carried smoothly in the developer carrying direction. That is, the developer can be carried smoothly through a traveling waveform electric field.

According to another aspect of the invention, there is provided a developer supplying device, comprising: a plurality of first carrying electrodes arranged along a developer carrying path, the plurality of first electrodes serving to carry the developer in a developer carrying direction intersecting with a main scanning direction when a first carrying voltage formed in a traveling waveform is applied to the plurality of first electrodes; a plurality of second carrying electrodes which are arranged along the developer carrying path to face the plurality of first electrodes while sandwiching the developer carrying path between the plurality of first and second electrodes, the plurality of second electrodes serving to carry the developer in the developer carrying direction when a second carrying voltage formed in a traveling waveform is applied to the plurality of second electrodes; a first carrying voltage applying unit configured to apply the first carrying voltage having a first frequency to the plurality of first carrying electrodes; and a second carrying voltage applying unit configured to apply, to the plurality of second carrying electrodes, the second carrying voltage having a second frequency different from the first frequency of the first carrying voltage.

Since the second carrying voltage of which frequency is different from the frequency of the first carrying voltage is applied to the second electrodes, the developer can be carried smoothly in the developer carrying direction. That is, the developer can be carried smoothly through a traveling waveform electric field.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

BRIEF DESCRIPTION OF THE ACCOMPANYING DRAWINGS

FIGS. 4A, 4B and 4C are explanatory illustrations for explaining carrying of toner on a toner carrying surface.

DETAILED DESCRIPTION

Hereafter, an embodiment according to the invention will be described with reference to the accompanying drawings.

Figure 1:
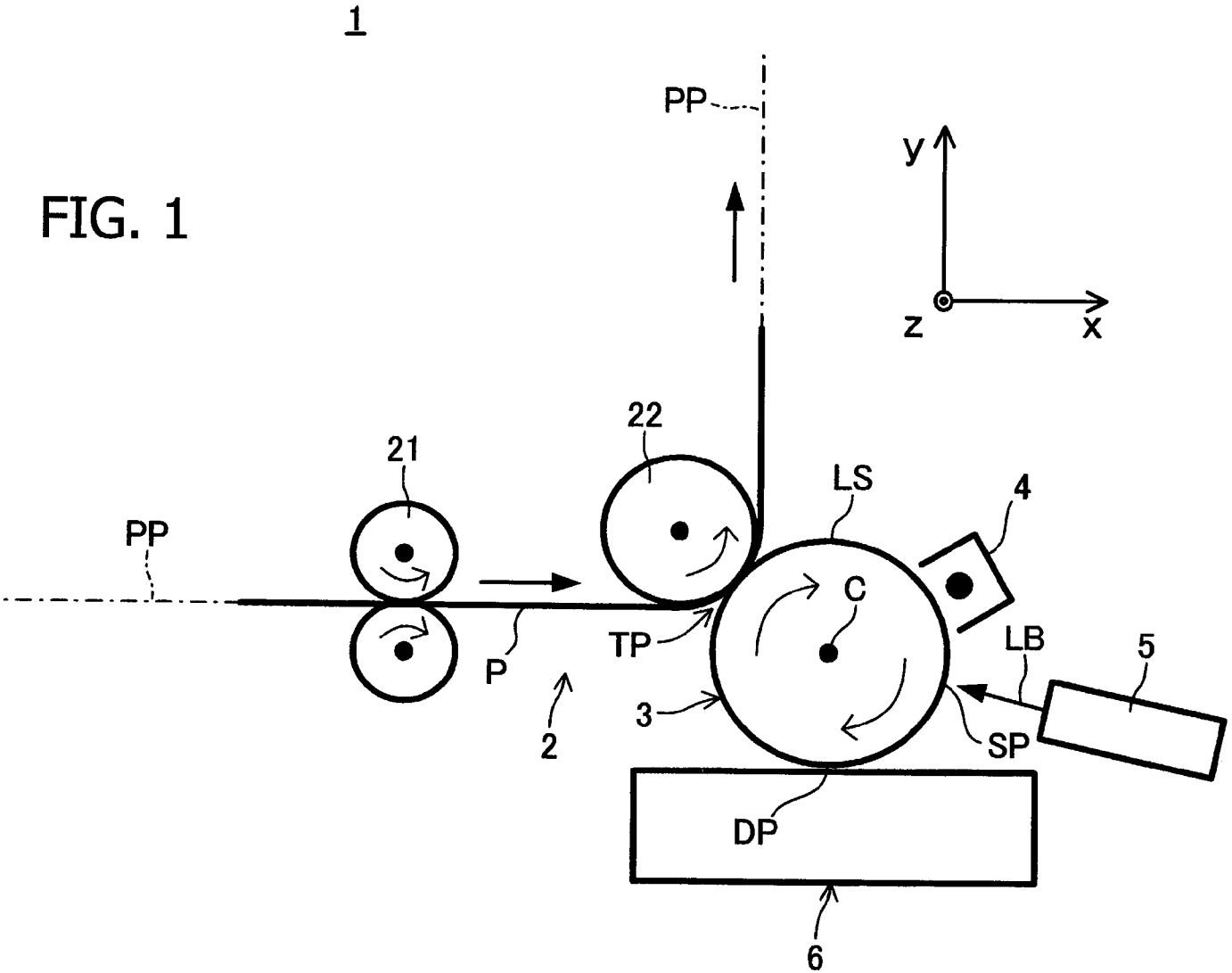
FIG. 1 illustrates a general configuration of a printer according to an embodiment.

FIG. 1 illustrates a general configuration of a printer 1 (i.e., an image formation device) according to an embodiment. As shown in FIG. 1, the printer 1 includes a sheet carrying mechanism 2, a photosensitive drum 3, a charger 4, a scanning unit 5 and a toner supply unit 6.

On a sheet supply tray (not shown) provided in the printer 1, a stack of sheets of paper P is placed. The sheet carrying mechanism 2 is configured to carry a sheet of paper P along a predetermined paper supply path PP.

On an outer circumferential surface of the photosensitive drum 3, a latent image formation surface LS is formed as a holding surface for developer. The latent image formation surface LS is formed as a cylindrical surface positioned to be parallel with a main scanning direction (z-direction in FIG. 1). On the latent image formation surface LS, a latent image is formed by as a potential distribution.

The photosensitive drum 3 is rotated about a center axis C in a rotational direction indicated by an arrow in FIG. 1. That is, the photosensitive drum 3 is rotated such that the latent image formation surface LS moves in an auxiliary scanning direction which is perpendicular to the main scanning direction.

The term "auxiliary scanning direction" means one of directions perpendicular to the main scanning direction. Typically, the auxiliary scanning direction is defined as a direction intersecting with a vertical axis. In other words, the auxiliary scanning direction is defined as a direction parallel with a back-and-forth direction (i.e., x-direction which is perpendicular to a width direction of the sheet of paper and a direction of the height of the stack of sheets of paper).

The charger 4 is placed to face the latent image formation surface LS. The charger 4 is, for example, a corotron type charger or a scorotron type charger. The charger 4 is configured to charge uniformly the latent image formation surface LS.

The scanning unit 5 is configured to emit a laser beam LB modulated based on image data. That is, the scanning unit 5 emits the laser beam LB which has a predetermined wavelength band and is on/off modulated in accordance with presence or absence of an image pixel in the image data.

The scanning unit 5 is configured to converge the laser beam LB at a scanning position SP on the latent image formation surface LS. In this case, the scanning position SP is defined at a downstream side position along a rotation direction of the photosensitive drum 3 (i.e., a rotational direction (clockwise direction) indicated by an arrow in FIG. 1).

Further, the scanning unit 5 is configured to form a latent image on the latent image formation surface FS by moving the position at which the laser beam LB is converged on the latent image formation surface LS, in the main scanning direction at a constant speed.

The toner supplying unit 6 is located to face the photosensitive drum 3. The toner supplying unit 6 is configured to supply charged toner (which is dry type developer) to the latent image formation surface LS. The toner supplying unit 6 is described in detail later.

Hereafter, each internal unit in the printer 1 is described.

The sheet carrying mechanism 2 includes a pair of registration rollers 21 and a transfer roller 22. The registration roller 21 is configured to feed the sheet of paper P toward gap between the photosensitive drum 3 and the transfer roller 22 at predetermined timing.

The transfer roller 22 is located to face the photosensitive drum 3 to sandwich the sheet of paper P between the transfer roller 22 and the latent image formation surface LS at a transfer position TP. Further, the transfer roller 22 is rotated in a rotational direction indicated by an arrow in FIG. 1 (i.e., a counterclockwise direction).

The transfer roller 22 is connected to a bias power circuit (not shown). That is, between the transfer roller 22 and the photosensitive drum 3, a transfer bias voltage is applied to transfer toner (developer) adhered to the latent image formation surface LS to the sheet of paper P.

Figure 2:
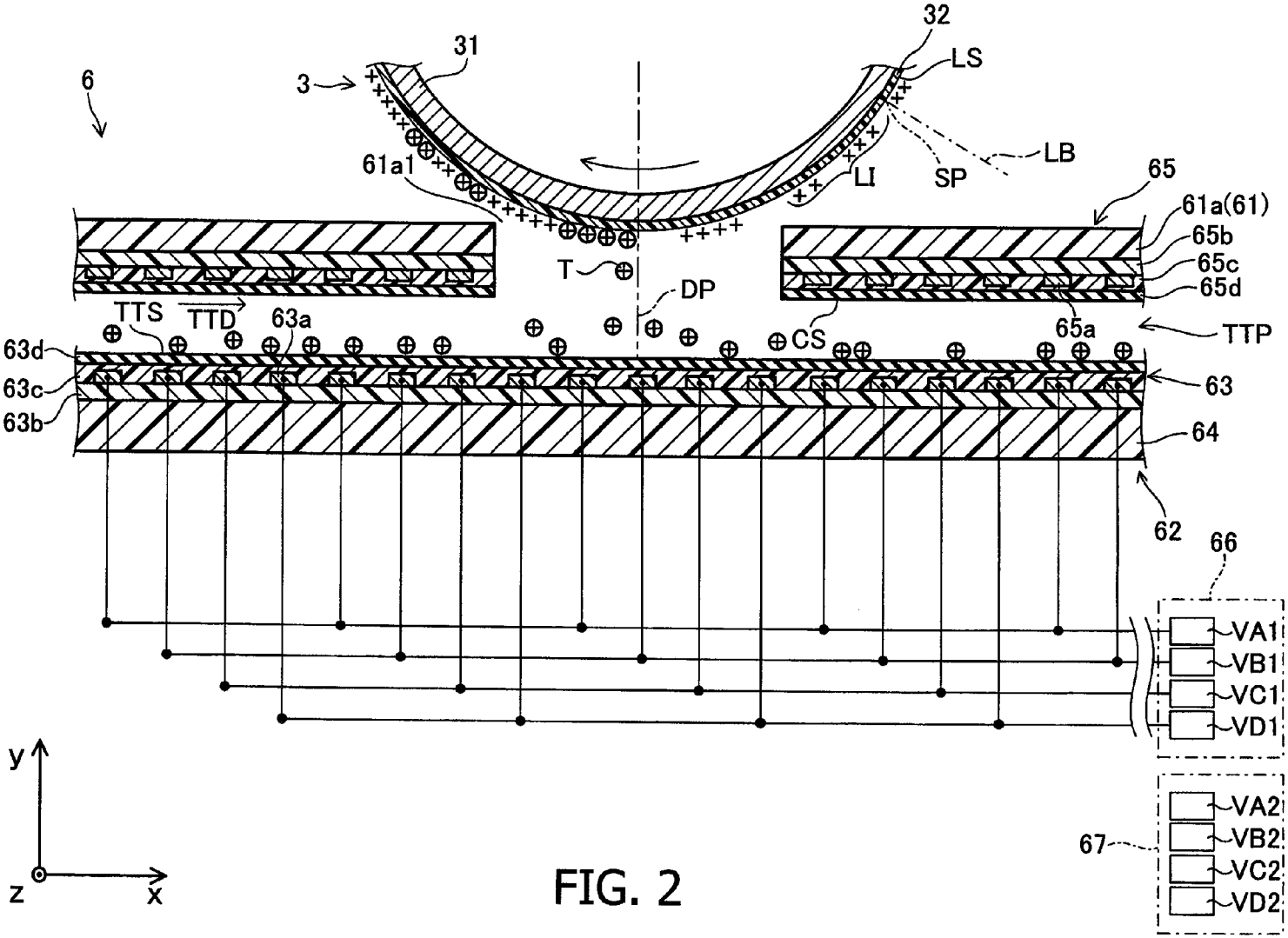
FIG. 2 is an enlarged side cross section illustrating a portion including a development position DP at which a photosensitive drum and a toner supplying unit face with respect to each other.

FIG. 2 is an enlarged side cross section illustrating a portion including a development position DP at which the photosensitive drum 3 and the toner supplying unit 6 face with respect to each other. As shown in FIG. 2, the photosensitive drum 3 includes a drum body 31 and a photosensitive layer 32. The drum body 31 is a cylindrical member having the center axis C which is parallel with the z-axis. The drum body 31 is grounded.

The photosensitive layer 32 is provided to cover an outer surface of the drum body 31. The photosensitive layer 32 is formed of a photosensitive layer which has a positive electrostatic property and exhibits an electronic conduction property by exposure to laser light having a predetermined wavelength.

The latent image formation surface LS is formed by the outer circumferential surface of the photosensitive layer 32. That is, the latent image formation surface LS (i.e., the photosensitive layer 32) is configured such that a latent image L1 formed of a positively charged pattern is formed by scanning the laser beam LB at the scanning position SP after the latent image formation surface LS is charged positively and uniformly by the charger 4.

The toner supply unit 6 according to the embodiment is configured to supply charged toner T (developer) to the latent image formation surface LS while carrying the charged toner T along a toner transport path TTP. The toner supply unit 6 is explained in detail below.

The toner supply unit 6 includes a toner box 61 serving as a casing. The toner box 61 is a box-shaped member and is configured to accommodate therein the toner T which is finegrained dry type developer. In this embodiment, the toner T is single-component nonmagnetic black toner which has a positive electrostatic property.

A top plate 61*a* of the toner box 61 is located to face the photosensitive drum 3. The top plate 61*a* has a plate-like rectangular shape when viewed as a plan view and is located to be parallel with a horizontal plane.

As shown in FIG. 2, a toner through hole 61*a*1 is formed in the top plate 61. The toner through hole 61*a*1 serves as a through hole for letting the toner T pass therethrough when the toner T moves from the inside of the toner box 61 toward the photosensitive layer 32 in y-axis direction shown in FIG. 2. The toner through hole 61*a*1 is formed to have a rectangular shape having a longer side elongated in the main scanning direction (i.e., the z-axis direction in FIG. 2) and a shorter side elongated in the auxiliary scanning direction (i.e., the x-axis direction in FIG. 2).

The toner through hole 61*a*1 is located at a position where the top plate 61*a* is closest to the photosensitive layer 32. In addition, the toner through hole 61*a*1 is located such that the center of the toner through hole 61*a*1 substantially coincides with the development position DP.

In the toner box 61, a toner electric field carrying body 62 is provided. The toner electric field carrying body 62 has a toner transport surface TTS. The toner transport surface TTS is a surface facing the toner transport path TTP in the toner electric field carrying body 62, and is configured to be parallel with the main scanning direction.

The toner electric field carrying body 62 is located such that the toner transport surface TTS faces the latent image formation surface LS in a state where the toner transport surface TTS is closest to the latent image formation surface LS at the development position DP. In other words, the toner electric field carrying body 62 is located such that the closest position where the toner transport surface TTS is closest to the latent image formation surface LS coincides with the development position DP.

The toner electric field carrying body 62 is a plate-like member having a predetermined thickness. The toner electric field carrying body 62 is configured to carry the toner T on the toner transport surface TTS in a predetermined toner transport direction TTD. The toner transport direction TTD is parallel with the toner transport surface TTS and is perpendicular to the main scanning direction (z-direction). That is, the toner transport direction TTD is a direction along the auxiliary scanning direction (x-direction).

The toner electric field carrying body 62 has a carrying printed circuit board 63. The carrying printed circuit board 63 is located to face the latent image formation surface LS while sandwiching the top plate 61*a* of the toner box 61 and the toner through hole 61*a*1 between the carrying printed board 63 and the latent image formation surface LS. For example, the carrying printed circuit board 63 has a structure like a flexible printed circuit board.

In the toner electric field carrying body 62, a plurality of carrying electrodes 63*a* are formed. Each of the carrying electrodes 63*a* is formed to be a linear patter having a longitudinal direction parallel with the main scanning direction (i.e., perpendicular to the auxiliary scanning direction). More specifically, the carrying electrode 63*a* is formed of copper foil and has the thickness of approximately several tens of micrometers. The carrying electrodes 63*a* are arranged to be parallel with each other. Further, the carrying electrodes 63*a* are arranged along the auxiliary scanning direction and are located along the toner transport surface TTS. That is, the carrying electrodes 63*a* are located near the toner transport surface TTS.

The toner carrying electrodes 63*a* are formed on a carrying electrode support film 63*b*. The carrying electrode support film 63*b* is a flexible film made of insulating synthetic resin, such as polyimide resin.

A carrying electrode coating layer 63*c* is made of insulating synthetic resin. The carrying electrode coating layer 63*c* is provided to cover the carrying electrodes 63*a* and the surface of the carrying electrode support film 63*b* on which the carrying electrodes 63*a* are formed.

On the carrying electrode coating layer 63*c*, a carrying electrode overcoating layer 63*d* is provided. That is, the carrying electrode coating layer 63*c* is formed between the carrying electrode overcoating layer 63*d* and the carrying electrodes 63*a*. The toner transport surface TTS is formed as a surface of the carrying electrode overcoating layer 63*d*, and is formed to be a smooth surface on which almost no bumps and dips are formed.

The toner electric field carrying body 62 is further provided with a carrying circuit board support member 64. The carrying circuit board support member 64 is a plate-like member formed of synthetic resin, and is located to support the carrying printed circuit board 63 from the bottom side.

On the inner surface of the top plate 61*a* of the toner box 61 (i.e., a surface of the top plate 61*a* facing space in which the toner T is accommodated), an opposite printed circuit board 65 is attached. The opposite printed circuit board 65 is located to face the toner transport surface TTS while sandwiching predetermined space between the opposite printed circuit board 65 and the toner transport surface TTS. The opposite printed circuit board 65 has the same structure as that of the carrying printed circuit board 63.

More specifically, the opposite printed circuit board 65 has an opposite circuit board surface CS which is parallel with the main scanning direction. The opposite circuit board surface CS is located to face the toner transport surface TTS while sandwiching the toner transport path TTP between the opposite circuit board surface CS and the toner transport surface TTS. Along the opposite circuit board surface CS, a plurality of opposite electrodes 65*a* are provided. That is, the opposite electrodes 65*a* are located near the opposite circuit board surface CS.

Each of the opposite electrodes 65*a* is formed to be a linear patter having a longitudinal direction parallel with the main scanning direction (i.e., perpendicular to the auxiliary scanning direction). More specifically, each opposite electrode 65*a* is formed of copper foil and has the thickness of approximately several tens of micrometers. The opposite electrodes 65*a* are arranged to be parallel with each other. Further, the opposite electrodes 65*a* are arranged along the auxiliary scanning direction.

The opposite electrodes 65*a* are formed on an opposite electrode support film 65*b*. The opposite electrode support film 65*b* is a flexible film made of insulating synthetic resin, such as polyimide resin.

An opposite electrode coating layer 65*c* is made of insulating synthetic resin. The opposite electrode coating layer 65*c* is provided to cover the opposite electrodes 65*a* and the surface of the opposite electrode support film 65*b* on which the opposite electrodes 65*a* are formed.

On the opposite electrode coating layer 65*c*, an opposite electrode overcoating layer 65*d* is provided. That is, the opposite electrode coating layer 65*c* is formed between the opposite electrode overcoating layer 65*d* and the opposite electrodes 65*a*. The opposite circuit board surface CS is formed as a surface of the opposite electrode overcoating layer 65*d*, and is formed to be a smooth surface on which almost no bumps and dips are formed.

The carrying electrodes 63*a* are connected to a first carrying voltage applying unit 66 which includes four power circuits VA1, VB1, VC1 and VD1. The carrying electrodes 63*a* arranged in the auxiliary scanning direction are connected to the first carrying voltage applying unit 66 such that the carrying electrodes 63*a* are connected to the same power circuit at every four intervals. More specifically, the carrying electrode 63*a* connected to the power circuit VA1, the carrying electrode 63*a* connected to the power circuit VB1, the carrying electrode 63*a* connected to the power circuit VC1 and the carrying electrode 63*a* connected to the power circuit VD1 are repeatedly arranged in the arrangement of the carrying electrodes 63*a*.

Each of the power circuits VA1, VB1, VC1 and VD1 outputs substantially the same alternating voltage (carrying voltage). The power circuits VA1, VB1, VC1 and VD1 output the alternating voltages such that each of waveforms of the alternating voltages has a phase shift of 90°. More specifically, in the order of the power circuits VA1, VB1, VC1 and VD1, a next alternating voltage has the phase shift of 90° with respect to a preceding alternating voltage.

Similarly, the opposite electrodes 65*a* are connected to a second carrying voltage applying unit 67 which includes four power circuits VA2, VB2, VC2 and VD2. The opposite electrodes 65*a* arranged in the auxiliary scanning direction are connected to the second carrying voltage applying unit 67 such that the opposite electrodes 65*a* are connected to the same power circuit at every four intervals. More specifically, the opposite electrode 65*a* connected to the power circuit VA2, the opposite electrode 65*a* connected to the power circuit VB2, the opposite electrode 65*a* connected to the power circuit VC2 and the opposite electrode 65*a* connected to the power circuit VD2 are repeatedly arranged in the arrangement of the opposite electrodes 65*a*.

Each of the power circuits VA2, VB2, VC2 and VD2 outputs substantially the same alternating voltage (carrying voltage). The power circuits VA2, VB2, VC2 and VD2 output the alternating voltages such that each of waveforms of the alternating voltages has a phase shift of 90°. More specifically, in the order of the power circuits VA2, VB2, VC2 and VD2, a next alternating voltage has the phase shift of 90° with respect to a preceding alternating voltage.

In this embodiment, the first and second carrying voltage applying units 66 and 67 output alternating voltages whose frequencies are different from each other. For example, the frequency of the output voltage of the first carrying voltage applying unit 66 and the frequency of the output voltage of the second carrying voltage applying unit 67 are set such that one of the frequency of the first and second carrying voltage applying units 66 and 67 is not an integral multiple of the frequency of the other of the first and second carrying voltage applying units 66 and 67.

Operations of the printer 1 configured as described above will now be explained. As shown in FIG. 1, the sheet of paper P stacked on a paper supply tray (not shown) is carried along the paper supply path PP so that the leading edge of the sheet of paper P reaches the registration roller 21. By the registration roller 21, skew of the sheet of paper P is corrected, and carrying timing is adjusted. Then, the sheet of paper P is carried to the transfer position TP along the paper supply path PP.

While the sheet of paper P is carried to the transfer position TP, an image of the toner T is formed on the latent image formation surface LS as described below.

First, the latent image formation surface LS of the photosensitive drum 3 is charged positively and uniformly by the charger 4.

The latent image formation surface LS is then moved, in the auxiliary scanning direction, to the scanning position SP where the latent image formation surface LS faces the scanning unit 5, through rotations of the photosensitive drum 3 in the direction indicated by an arrow in FIG. 1 (i.e., in the clockwise direction).

As shown in FIG. 2, the laser beam LB which has been modulated by the image data scans at the scanning position SP on the latent image formation surface LS in the main scanning direction. According to the modulated status of the laser beam LB, a part of positive charges on the latent image formation surface LS disappears. Therefore, a latent image LI is formed on the latent image formation surface LS as a positive charge pattern (i.e., an image-like distribution).

The latent image LI formed on the latent image formation surface LS moves to the development position DP which faces the toner supply unit 6, through rotations of the photosensitive drum 3 in the rotational direction indicated by an arrow in FIG. 1 (i.e., the clockwise direction).

In the above described configuration, a voltage having a form of a traveling wave is applied to the plurality of carrying electrodes 63*a*. Therefore, a predetermined traveling electric field is formed on the toner transport surface TTS. Through the traveling wavelength electric field, the toner T (positive charge) is carried on the toner transport surface TTS in the toner transport direction TTD.

Figure 3:
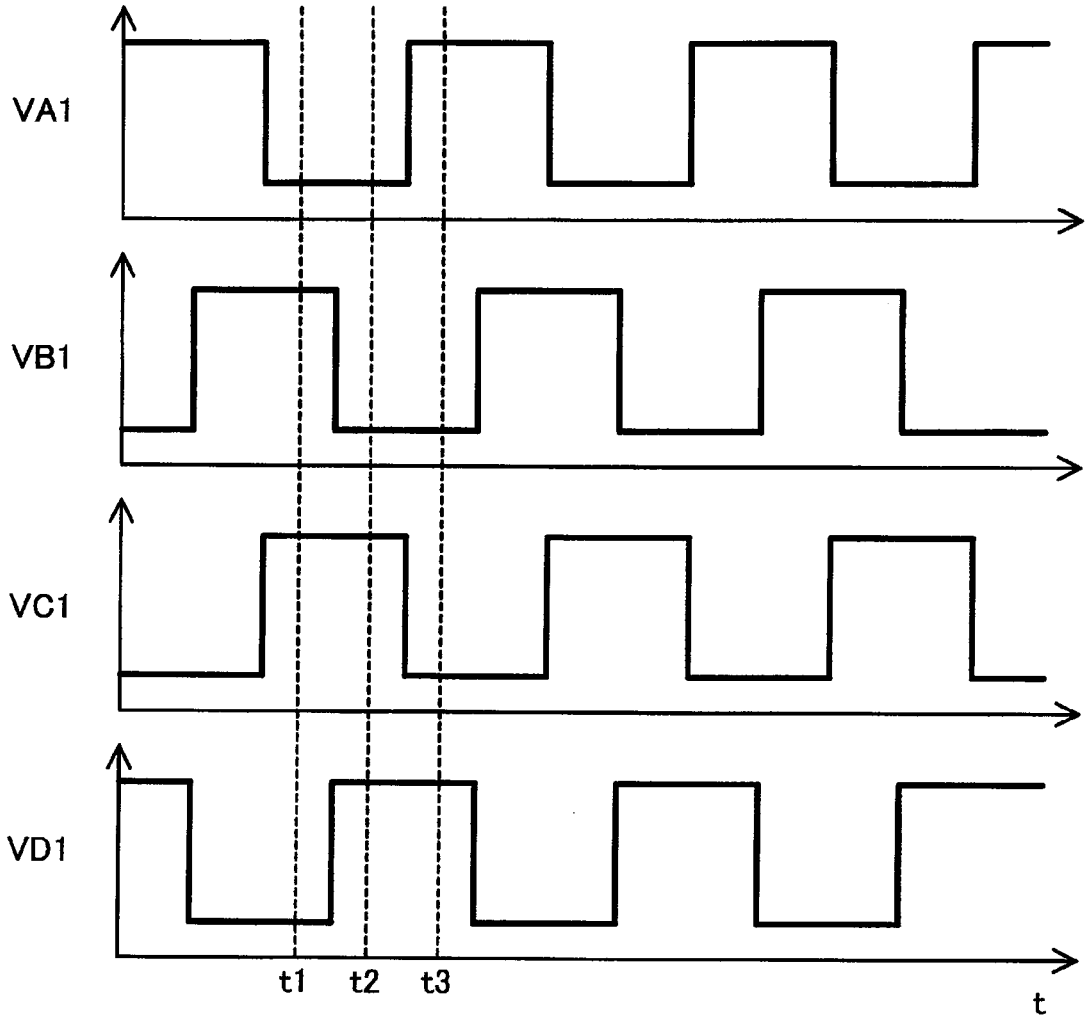
FIG. 3 illustrates waveforms of voltages output by power circuits VA1, VB1, VC1 and VD1, respectively.

FIG. 3 illustrates waveforms of the voltages output by the power circuits VA1, VB1, VC1 and VD1, respectively. FIGS. 4A, 4B and 4C are explanatory illustrations for explaining carrying of the toner T on the toner transport surface TTS. That is, each of FIGS. 4A, 4B and 4C is an enlarged side cross section of the toner electric field carrying body 62 illustrating a portion near the toner transport surface TTS shown in FIG. 2. In each of FIGS. 4A, 4B and 4C, the carrying electrode 63*a* connected to the power circuit VA1 is assigned a reference number 63*a*A, the carrying electrode 63*a* connected to the power circuit VB1 is assigned a reference number 63*a*B, the carrying electrode 63*a* connected to the power circuit VC1 is assigned a reference number 63*a*C, and the carrying electrode 63*a* connected to the power circuit VD1 is assigned a reference number 63*a*D. Hereafter, carrying of the toner T (positive charge) on the toner transport surface TTS in the toner transport direction TTD is explained with reference to FIGS. 3 and 4A-4C.

As shown in FIG. 4A, at a time t1 in FIG. 3, an electric field EF1 having a direction opposite to the toner transport direction TTD (i.e., the direction opposite to the x-direction in FIGS. 4A-4C) is formed between the position (hereafter, frequently referred to as the position A) of the carrying electrode 63*a*A and the position (hereafter, frequently referred to as the position B) of the carrying electrode 63*a*B. On the other hand, an electric field EF2 having a direction equal to the toner transport direction TTD (i.e., x-direction in FIGS. 4A-4C) is formed between the position (hereafter, frequently referred to as the position C) of the carrying electrode 63*a*C and the position (hereafter, frequently referred to as the position D) of the carrying electrode 63*a*D. Between the positions B and C and between the positions D and A, no electric field is formed along the toner transport direction TTD.

That is, at the time t1, an electrostatic force having a direction opposite to the toner carrying direction acts on the positive toner T between the positions A and B. Between the positions A and B and between the positions B and C and, almost no electric static force acts on the toner T along the toner carrying direction. Between the positions C and D, an electrostatic force having a direction equal to the toner carrying direction acts on the positive toner T.

Therefore, at the time t1, the positive toner T gathers between the positions D and A. Similarly, at a time t2 (see FIG. 4B), the positive toner T gathers between the positions A and B. Next, at a time t3 (see FIG. 4C), the positive toner T gathers between the positions B and C.

That is, the position where the toner T gathers moves on the toner transport surface TTS in the toner carrying direction with the passage of time. As described above, by applying voltages shown in FIG. 3 to the carrying electrodes 63*a*, the traveling waveform electric field is formed on the toner transport surface TTS. Accordingly, the positive toner T is carried in the toner transport direction TTD in a hopping motion.

As shown in FIG. 2, a carrying motion of the toner T produced by the opposite printed circuit board 65 is substantially the same as the carrying motion of the toner T produced by the carrying printed circuit board 63. As shown in FIG. 2, the positive toner T is carried on the toner transport surface TTS in the toner transport direction TTD. Consequently, the toner T is supplied to the development position DP.

Near the development position DP, the latent image LI formed on the latent image formation surface LS is developed with the toner T. That is, the toner T adheres to the portion from which the positive charges are removed from the latent image LI, by which an image formed by the toner T (hereafter, frequently referred to as a "toner image") is held on the latent image formation surface LS.

As shown in FIG. 1, the toner image held on the latent image formation surface LS of the photosensitive drum 3 is carried to the transfer position TP by rotation of the latent image formation surface LS in the rotational direction indicated by the arrow in FIG. 1 (i.e., in the clockwise direction). At the transfer position TP, the toner image is transferred from the latent image formation surface LS to the sheet of paper P.

FIGS. 5A-5B to 9A-9B show simulation results of motion of the toner T when the voltages are applied to the carrying electrodes 63*a* and the opposite electrodes 65*a* through the first and second carrying voltage applying units 66 and 67. The simulation is performed in accordance with Distinctive Element Method under the following conditions. For easiness of calculations, the thickness of each of the carrying electrode 63*a* and the opposite electrode 65*a* is defined as zero, each of various types of coatings is defined as having the thickness of 25 μm and having the specific inductive capacity of 2.5.

<Calculation Conditions>

Calculation Space Range: 1.6 mm in x-direction, 0.5 mm in y-direction, 0.03 mm in z-direction (Toner Carrying Surface: y=0, Opposite Circuit Board Surface: y=0.5)

Width of each electrode in x-direction: 0.1 mm

Gap between adjacent electrodes in x-direction: 0.1 mm

Total Number of particles: 2000, Diameter of a toner particle: 10 μm

Charge of a toner particle: 2 fC, Density of a toner particle: 1.3 g/cm$^3$

Applied Voltage: ±300V (sine wave)

Calculation time range: 0.01 seconds

Each of FIGS. 5A, 6A, 7A and 8A shows motion of the toner T when the voltage supplied by the first carrying voltage applying unit 66 and the voltage supplied by the second carrying voltage applying unit 67 have different frequencies (e.g., Frequency of VA1-VD1: 500 Hz, Frequency of VA2-VD2: 400 Hz). Each of FIGS. 5B, 6B, 7B and 8B shows motion of the toner T when the frequency of the voltage supplied by the first carrying voltage applying unit 66 is equal to the frequency of the voltage supplied by the second carrying voltage applying unit 67 (e.g., Frequency of VA1-Vd1: 500 Hz, Frequency of VA2-VD2: 500 Hz).

Figure 5A:
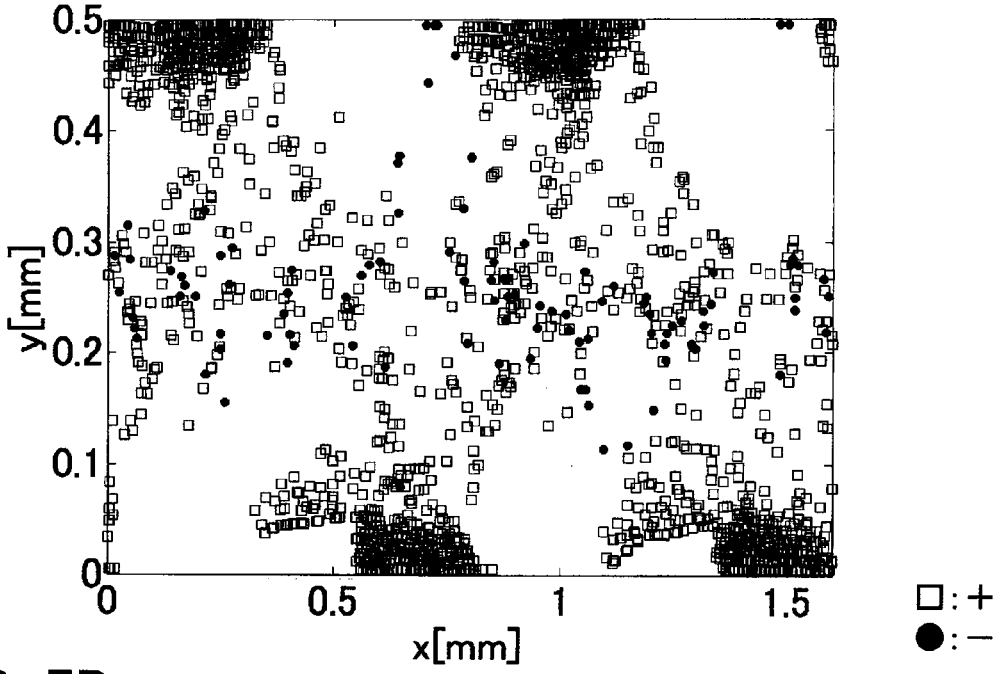
FIGS. 5A and 5B show simulation results obtained with the assumption that the toner contains 5% toner having an inverse electrostatic property.
Figure 5B:
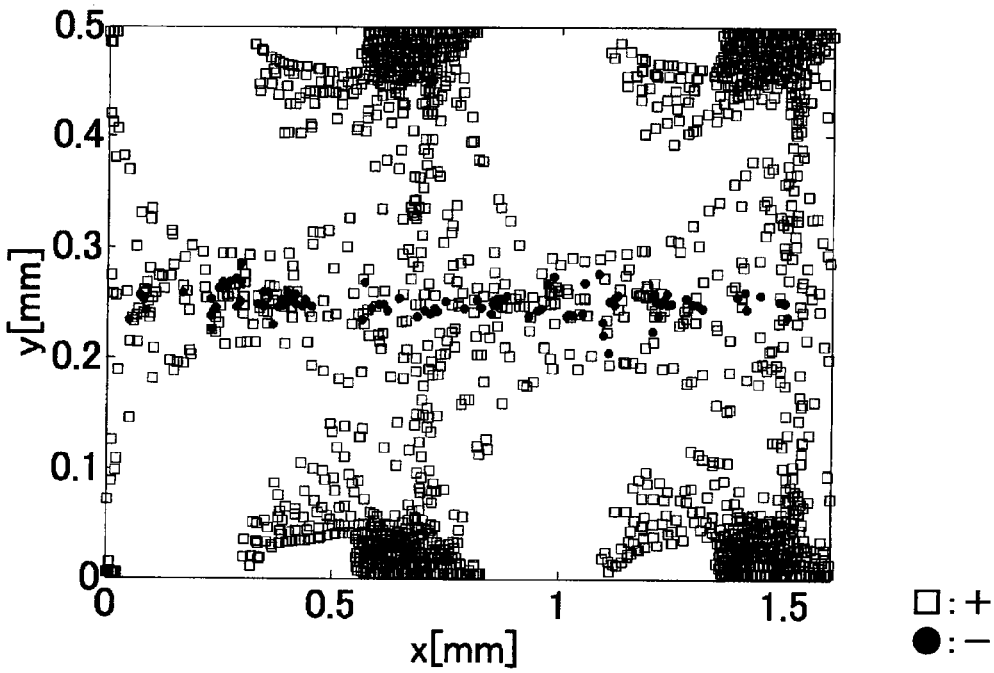
Figure 6A:
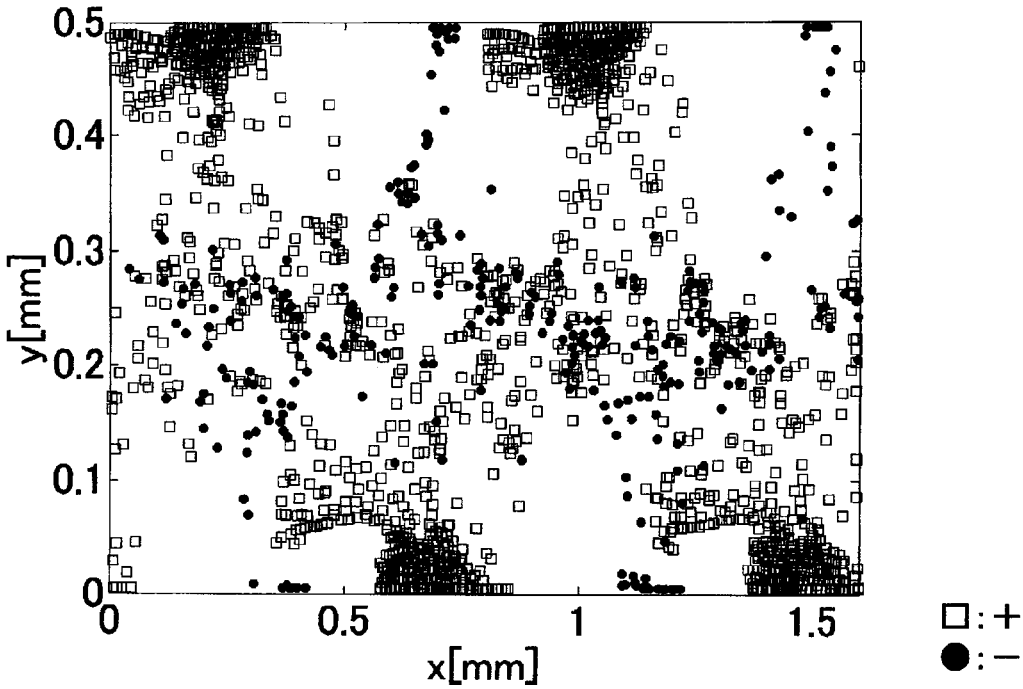
FIGS. 6A and 6B show simulation results obtained with the assumption that the toner contains 15% toner having an inverse electrostatic property.
Figure 6B:
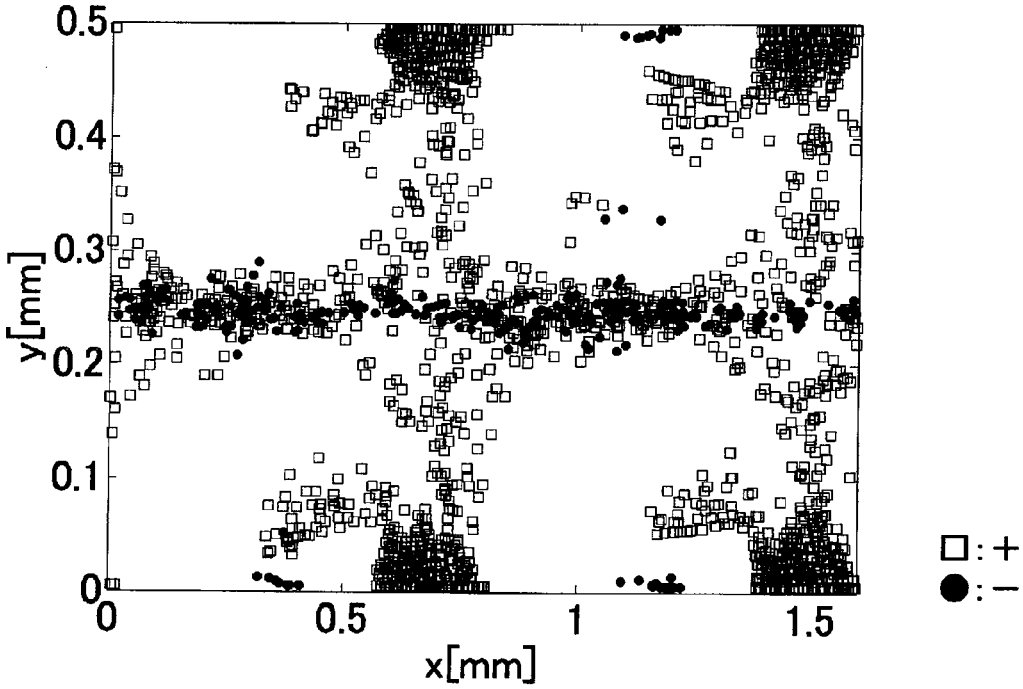

As described above, in this embodiment, the toner T has the positive electrostatic property. However, typically, toner having an inverse electrostatic property (a negative electrostatic property in this embodiment) is also produced. For this reason, FIGS. 5A and 5B show simulation results obtained with the assumption that the toner T contains 5% toner having an inverse electrostatic property. FIGS. 6A and 6B show simulation results obtained with the assumption that the toner T contains 15% toner having an inverse electrostatic property.

Figure 7A:
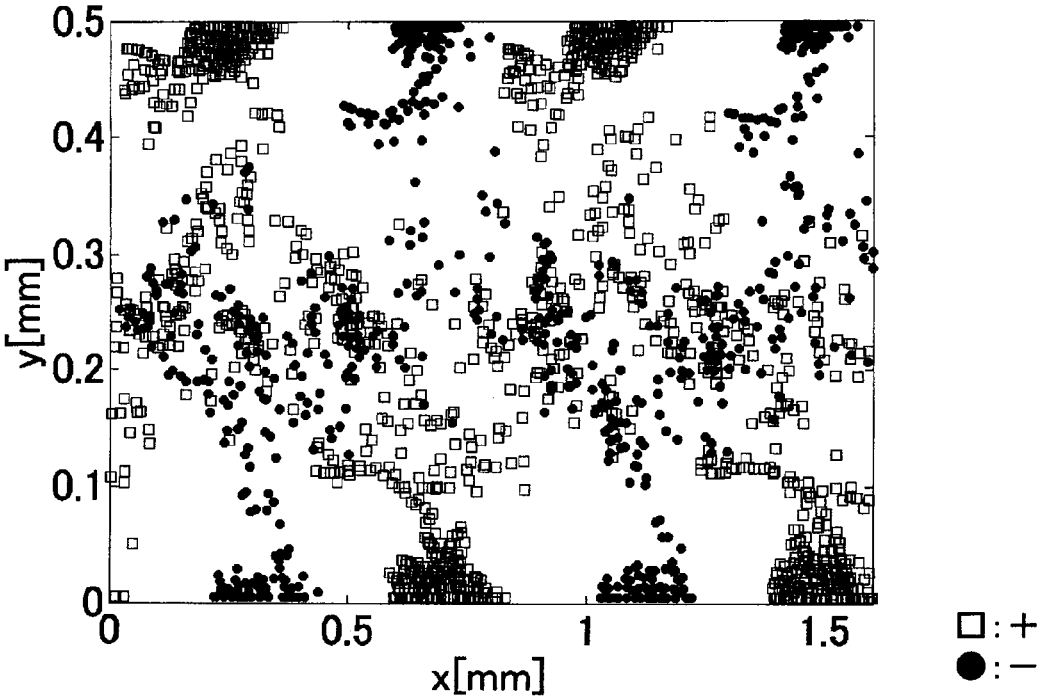
FIGS. 7A and 7B show simulation results obtained with the assumption that the toner contains 35% toner having an inverse electrostatic property.
Figure 7B:
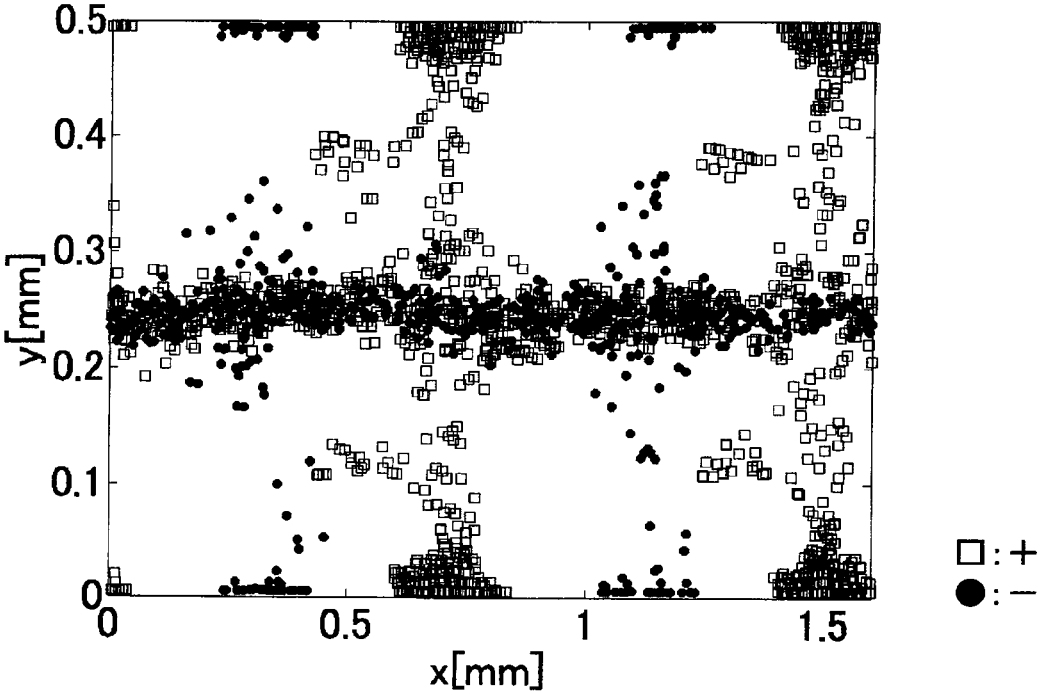
Figure 8A:
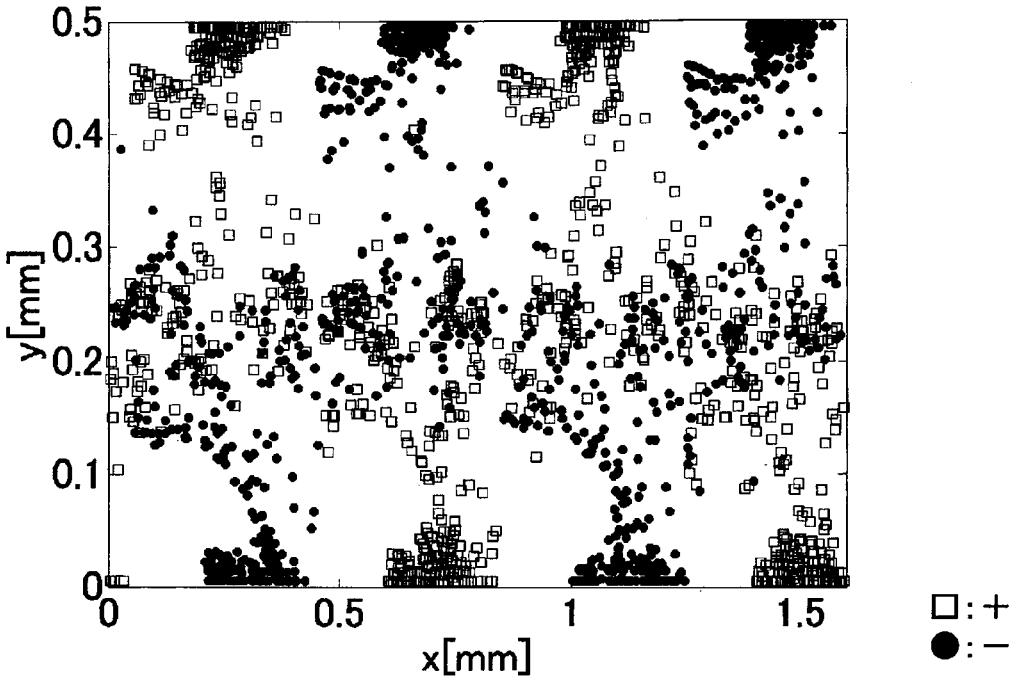
FIGS. 8A and 8B show simulation results obtained with the assumption that the toner contains toner having a positive electrostatic property and toner having a negative electrostatic property at the rate of 1-to-1.
Figure 8B:
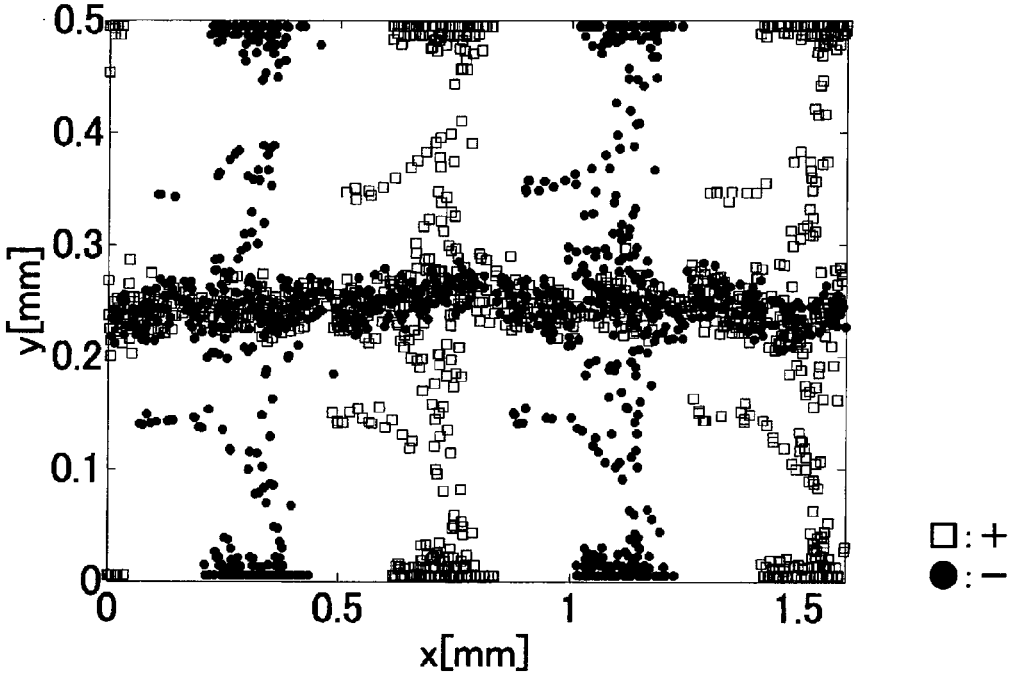

There is a case where toner having the positive electrostatic property and toner having the negative electrostatic property are mixed at predetermined proportions, for example, as disclosed in Japanese Patent Provisional Publication No. HEI 5-19616A. For this reason, FIGS. 7A and 7B show simulation results obtained with the assumption that the toner T contains 35% toner having an inverse electrostatic property. FIGS. 8A and 8B show simulation results obtained with the assumption that the toner T contains toner having a positive electrostatic property and toner having a negative electrostatic property in proportions of 1-to-1.

Figure 9A:
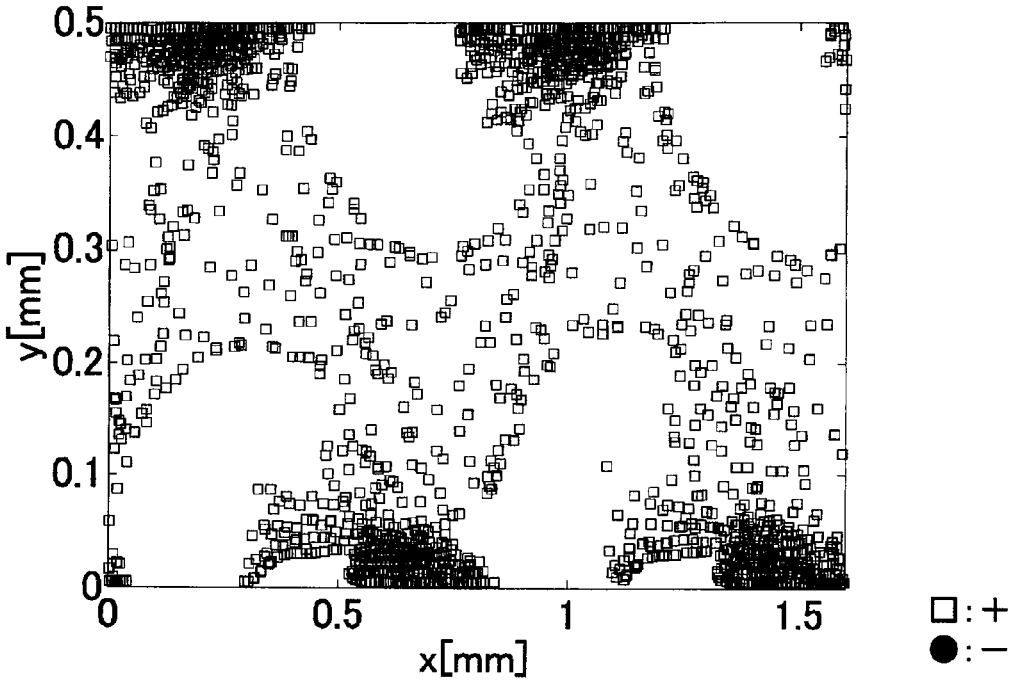
FIGS. 9A and 9B show simulation results obtained with the assumption that the toner contains no toner having the inverse electrostatic property.
Figure 9B:
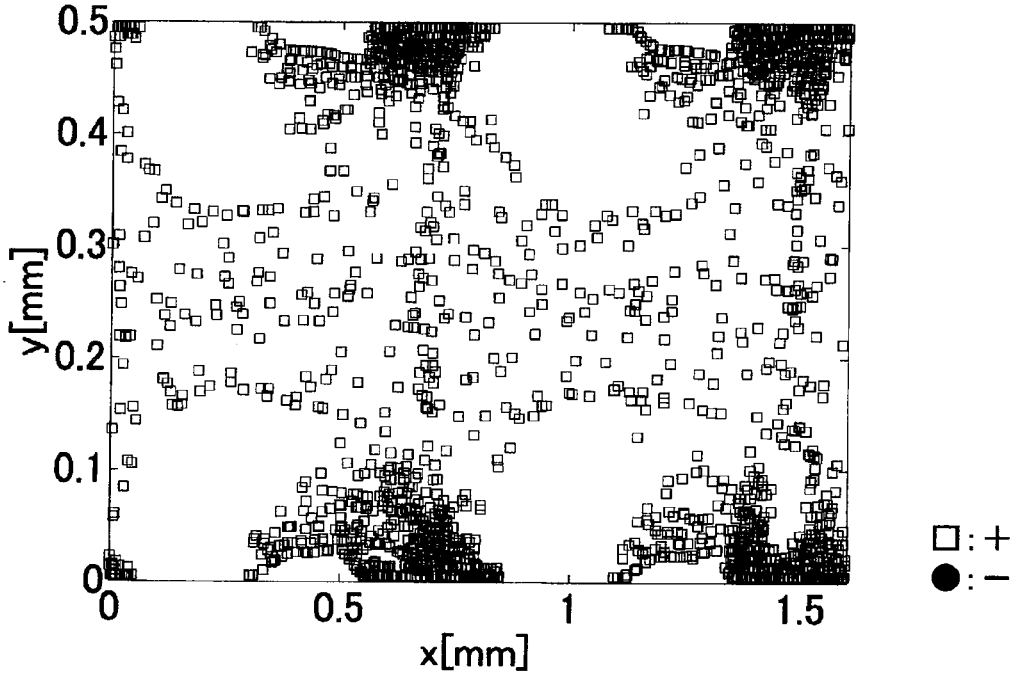

For reference purposes, FIGS. 9A and 9B show simulation results obtained with the assumption that the toner T contains no toner having the inverse electrostatic property. However, it should be noted that practically such a situation where the toner T contains no toner having the inverse electrostatic property does not occur in a typical electrophotographic process. Regarding the cases where the positive electrostatic property toner and the negative electrostatic property toner are mixed in the inverse mixture ratio with respect the above described cases, the same simulation results can be obtained. Therefore, explanations of the cases for the inverse mixture ratio are omitted for the sake of simplicity.

If the toner T has no inverse electrostatic property toner, there is no substantive difference between the case where the frequency of the voltage from the carrying electrodes and the frequency of the voltage from the opposite electrodes are equal to each other and the case where the frequency of the voltage from the carrying electrodes and the frequency of the voltage from the opposite electrodes are different from each other. Rather, in this case, it appears that the case where the frequency of the voltage from the carrying electrodes and the frequency of the voltage from the opposite electrodes are equal to each other exhibits a suitable carrying condition of the toner T.

However, as shown in FIG. 5B, at a miniscule 5% of the ratio of the inverse electrostatic property toner, the toner T concentrates remarkably at the central portion in the y-axis direction in the case where the frequency of the voltage from the carrying electrodes and the frequency of the voltage from the opposite electrodes are equal to each other. If such concentration of the toner T occurs, the density of the toner T near the toner transport surface TTS or the opposite circuit board surface CS, where the intensity of the electric field intensity is large and therefore the toner T can be carried easily, decreases. In this case, coagulation of toner also occurs. Consequently, the carrying movement of the toner T also deteriorates. Such a tendency becomes remarkable as the ratio of the inverse electrostatic property toner increases. More specifically, when the ratio of the inverse electrostatic property toner is larger than or equal to 15%, the ratio of the toner existing in the central portion takes the maximum value. If the ratio of the inverse electrostatic property toner exceeds 30%, the more that half of the toner T concentrates in the central portion.

By contrast, according to the embodiment, since the frequency of the voltage applied by the carrying electrode is set to be different from the frequency of the voltage applied by the opposite electrode (particularly by setting one of the frequencies not to be an integral multiple of the other of the frequencies), the concentration of the toner T in the y-axis direction can be reduced. Therefore, even if the toner T contains the inverse electrostatic property toner, the toner T can be carried suitably.

As described above according to the embodiment, the toner T can be carried smoothly in the toner transport direction TTD through the traveling waveform electric filed applied by the carrying printed circuit board 63 and the opposite printed circuit board 65.

The carrying performance of the toner T enhances dramatically particularly when positive electrostatic minute particles and negative electrostatic minute particles are mixed intentionally at predetermined proportions, when the positive electrostatic toner and the negative electrostatic toner are mixed intentionally at predetermined proportions, or when the positive electrostatic discharging material and the negative electrostatic discharging material are mixed intentionally at predetermined proportions.

Although the present invention has been described in considerable detail with reference to certain preferred embodiments thereof, other embodiments are possible.

In the following, variations of the above described embodiment are explained. It should also be understood that the present invention is not limited to the variations described below, and feature of a part or all of the variations may be combined.

Image formation devices to which the technical feature of the above described embodiment is applied is not limited to the monochrome laser printer. The technical feature of the above described embodiment may be applied to various types of image formation devices employing an electrophotographic process, such as a color laser printer, a monochrome or color facsimile device. In this case, a photosensitive body may have various types of shapes. That is, the photosensitive body may have a shape other than a cylindrical shape. For example, the photosensitive body may have a plate-like shape or a shape of an endless belt.

In the above described embodiment, the photosensitive drum 3 is used as a developer holding body. However, the developer holding body is not limited to such an example (i.e., a photosensitive drum).

For example, an image formation device may adopt, as a developer holding body, a development roller or a development sleeve which is provided with a cylindrical toner holding surface for holding the toner T as a thin film and which is located to face a photosensitive drum.

Alternatively, the technical feature of the above described embodiment may be applied to image formation devices having an imaging scheme (e.g., a toner jet scheme not using a photosensitive body, an ion flow scheme, or a multi-stylus electrode scheme) other than the above described electrophotographic process. In this case, a drum-like or a belt-like intermediate transfer body may be used as a developer holding body.

The structure of the carrying printed circuit board 63 and the opposite printed circuit board 65 is not limited to the above described embodiment. For example, the carrying electrode overcoating layer 63*d* or the opposite electrode overcoating layer 65*d* may be omitted.

What is claimed is:

1. An image formation device, comprising:

a developer holding body having a developer holding surface which is parallel with a main scanning direction and which holds thereon developer including a number of minute particles;

a developer supplying unit configured to carry charged developer to the developer holding body along a developer carrying path, wherein the developer supplying unit comprises:

a plurality of first carrying electrodes arranged along the developer carrying path, the plurality of first carrying electrodes serving to carry the developer in a developer carrying direction intersecting with the main scanning direction when a first carrying voltage formed in a traveling waveform is applied to the plurality of first carrying electrodes;

a plurality of second carrying electrodes which are arranged along the developer carrying path to face the plurality of first carrying electrodes while sandwiching the developer carrying path between the plurality of first and second carrying electrodes, the plurality of second carrying electrodes serving to carry the developer in the developer carrying direction when a second carrying voltage formed in a traveling waveform is applied to the plurality of second carrying electrodes;

a first carrying voltage applying unit configured to apply the first carrying voltage having a first frequency to the plurality of first carrying electrodes; and a second carrying voltage applying unit configured to apply, to the plurality of second carrying electrodes, the second carrying voltage having a second frequency different from the first frequency of the first carrying voltage.

2. The image formation device according to claim 1, wherein the second carrying voltage applying unit is configured to apply, to the plurality of second carrying electrodes, the second carrying voltage having the second frequency which is not an integral multiple of the first frequency of the first carrying voltage.

3. The image formation device according to claim 1, wherein the developer includes minute particles charged in a predetermined polarity and minute particles charged in a reversed polarity of the predetermined polarity.

4. The image formation device according to claim 1, wherein the developer includes positively charged toner and negatively charged toner in predetermined proportions.

5. A developer supplying device, comprising:

a plurality of first carrying electrodes arranged along a developer carrying path, the plurality of first carrying electrodes serving to carry developer in a developer carrying direction intersecting with a main scanning direction when a first carrying voltage formed in a traveling waveform is applied to the plurality of first carrying electrodes;

a plurality of second carrying electrodes which are arranged along the developer carrying path to face the plurality of first carrying electrodes while sandwiching the developer carrying path between the plurality of first and second carrying electrodes, the plurality of second carrying electrodes serving to carry the developer in the developer carrying direction when a second carrying voltage formed in a traveling waveform is applied to the plurality of second carrying electrodes;

a first carrying voltage applying unit configured to apply the first carrying voltage having a first frequency to the plurality of first carrying electrodes; and a second carrying voltage applying unit configured to apply, to the plurality of second carrying electrodes, the second carrying voltage having a second frequency different from the first frequency of the first carrying voltage.

6. The developer supplying device according to claim 5, wherein the second carrying voltage applying unit is configured to apply, to the plurality of second carrying electrodes, the second carrying voltage having the second frequency which is not an integral multiple of the first frequency of the first carrying voltage.

7. The developer supplying device according to claim 5, wherein the developer includes minute particles charged in a predetermined polarity and minute particles charged in a reversed polarity of the predetermined polarity.

8. The developer supplying device according to claim 5, wherein the developer includes positively charged toner and negatively charged toner in predetermined proportions.

* * * * *